US007695419B2

(12) United States Patent
Goto et al.

(10) Patent No.: US 7,695,419 B2
(45) Date of Patent: Apr. 13, 2010

(54) METHOD AND DEVICE FOR MANUFACTURING BAG WITH CLAMPING DEVICE

(75) Inventors: Shuichi Goto, Bunkyo-ku (JP); Kenichi Tanaka, Sodegaura (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 207 days.

(21) Appl. No.: 11/813,899

(22) PCT Filed: Jan. 12, 2006

(86) PCT No.: PCT/JP2006/300260

§ 371 (c)(1),
(2), (4) Date: Jul. 13, 2007

(87) PCT Pub. No.: WO2006/075644

PCT Pub. Date: Jul. 20, 2006

(65) Prior Publication Data

US 2009/0005228 A1 Jan. 1, 2009

(30) Foreign Application Priority Data

Jan. 13, 2005 (JP) ..... 2005-006420

(51) Int. Cl.
*B31B 1/90* (2006.01)

(52) U.S. Cl. ..... 493/215; 493/380; 493/927

(58) Field of Classification Search ..... 493/213, 493/380, 393, 927, 214, 215; 53/412, 133.4, 53/139.2

See application file for complete search history.

(56) References Cited

U.S. PATENT DOCUMENTS

| | | | | |
|---|---|---|---|---|
| 4,277,241 | A * | 7/1981 | Schulze | 493/927 |
| 4,341,575 | A * | 7/1982 | Herz | 493/213 |
| 4,372,793 | A * | 2/1983 | Herz | 493/213 |
| 6,640,519 | B1 * | 11/2003 | Goodwin | 493/213 |
| 6,840,897 | B2 * | 1/2005 | Knight | 493/213 |
| 6,942,609 | B2 * | 9/2005 | Knight | 493/213 |
| 2003/0089084 | A1 * | 5/2003 | Ausnit | 53/412 |

FOREIGN PATENT DOCUMENTS

| | | | |
|---|---|---|---|
| JP | 03-36825 | | 4/1991 |
| JP | 09-039121 | A | 2/1997 |
| JP | 409039121 | A * | 2/1997 |
| JP | 2003-155045 | A | 5/2003 |

* cited by examiner

*Primary Examiner*—Louis K Huynh
(74) *Attorney, Agent, or Firm*—Millen, White, Zelano & Branigan, P.C.

(57) ABSTRACT

A tape with a zipper member and a bag film are continuously moved by rotation of a rotary drum while being overlaid with each other such that the tape travels in a tape introducing groove for a tape with a zipper member, the groove formed along a circumferential direction of the rotary drum. The tape with the zipper member is continuously welded to the bag film on a circumferential surface of the rotary drum by a seal bar that has a welding surface in a curved shape corresponding to a circumferential surface shape of the rotary drum. A heat-insulation portion is provided on at least one of the tape body of the tape and the rotary drum so that heat applied from the seal bar to the tape with the zipper member is prevented from transferring to the rotary drum.

7 Claims, 8 Drawing Sheets

METHOD AND DEVICE FOR MANUFACTURING BAG WITH CLAMPING DEVICE

This is a 371 national stage entry of PCT/JP2006/300260 filed Jan. 12, 2006, which claims priority from a Japanese Patent Application No. 2005-006420 filed Jan. 13, 2005.

TECHNICAL FIELD

The present invention relates to a manufacturing method and manufacturing device for manufacturing a bag with a zipper member made of a bag film on which a tape with a zipper member is welded, a zipper member integrally formed on one surface side of a tape body of the tape.

BACKGROUND ART

A reclosable bag that is a bag openable and closable by belt-like zipper members (an engaging unit) of a male and a female, the zipper members provided to an opening/closing portion of the bag, has been used for many fields such as food, medical products and miscellaneous goods.

In manufacturing such a bag with the zipper members, a method has been known in which the zipper members are formed by extrusion molding while being welded to a surface of the bag film. However, the method contains a limitation on flexibility in combination of the zipper members and the bag film since the zipper members are welded at the same time as the molding. In addition, the molding of the zipper members cannot be conducted independently and the molding needs to be conducted with a limitation in cooling. Hence, it has been difficult to stably manufacture the bag with the zipper members.

As one example of related art technique for manufacturing the bag with the zipper members, there has been known an arrangement in which bag films are overlaid with each other while sandwiching tapes with the male and female zipper members in engagement, flat-plate-like seal bars are provided on outer sides of the bag films such that the seal bars can advance to and retract from the bag films, the bag films and the tapes with the zipper members are intermittently sent at a constant length pitch and the seal bars are brought into contact with the bag films, so that the tapes with the zipper members are welded to the bag films by utilizing heat of the seal bars (Patent Document 1). In Patent Document 1, a separator is disposed between the facing tapes with the zipper members.

As another example of the related art, there has been known an arrangement in which, when the tapes with the zipper members are welded to the bag films, the tapes and the bag films are continuously moved by rotation of the rotary drum while the tapes and the bag films are overlaid with each other such that the zipper members travel in a zipper member introducing groove formed along a circumferential direction of the rotary drum (Patent Document). In Patent Document 2, the zipper member introducing groove is formed in a rectangular shape. In the zipper member introducing groove, the zipper member is accommodated. A tape portion integrally provided to the zipper member has a larger width dimension to be welded to the bag film, the tape portion disposed along an outer circumferential surface of the rotary drum such that the tape portion can be welded to the bag film.

[Patent Document 1] JP-UM-B-H03-36825 (FIGS. 2 and 3)

[Patent Document 2] JP-A-H09-39121 (FIGS. 2 and 3)

DISCLOSURE OF THE INVENTION

Problems to be Solved by the Invention

In Patent Document 1, since the welding is conducted by intermittently sending the tapes and the bag films, its productivity is low. In addition, difference in force applied on the tapes with the zipper members and the bag films often causes wrinkles in the welding portion. Further, since the tape with the zipper member and the bag film are pressed between the separator and the seal bar, large resistance force is generated in peeling the bag with the zipper members from the separator, thereby causing a cut in an edge of the welding portion or a wrinkle.

In particular, with such type of the manufacturing device, the tapes with the zipper members may be displaced in a width direction when being intermittently sent and then welded with the displacement, so that the width of the tapes of the zipper members needs to be equal to or larger than 12 mm in order to be reliably welded on the bag films.

In Patent Document 2, unlike Patent Document 1, since the bags with the zipper members are continuously manufactured, the problem of low productivity and the problem caused by the separator will not happen. However, since the bag film is so disposed as to cover the tape portion, a step will be formed along a circumferential portion of the tape portion of the bag film. Hence, a wrinkle may be formed around the step in the film.

An object of the invention is to provide a manufacturing method and a manufacturing device which provide a bag with zipper members with a good appearance without a wrinkle around a welding portion even after the tapes with the zipper members and the bag films are welded.

Means for Solving the Problems

A manufacturing method for a bag with zipper members according to an aspect of the invention includes: overlaying a bag film with a tape with a zipper member in which the zipper member is integrally formed on one surface side of a tape body of the tape such that the tape with the zipper member travels in a zipper member introducing groove formed in a circumferential direction of a rotary drum, the tape and the bag film moved by rotation of the rotary drum in the overlaid state; and continuously heat-sealing the tape with the zipper member to the bag film by a seal bar having a welding surface in a curved shape corresponding to a circumferential shape of the rotary drum. Heat applied by the seal bar to the tape with the zipper member can be avoided from transferring to the rotary drum.

According to the aspect of the invention, when the tape with the zipper member and the bag film are heat-sealed by the rotary drum and the seal bar, it is possible to prevent heat that is transferred from the seal bar to the tape with the zipper member from escaping to the rotary drum. Accordingly, it is possible to avoid a seal defect of the tape with the zipper member such as a wrinkle formed in the welding portion.

In order to prevent the heat transferred from the seal bar to the tape with the zipper member from escaping to the rotary drum, the tape with the zipper member and/or the rotary drum may have an arrangement for heat-insulating (a heat-insulating portion).

In the manufacturing method of the bag with the zipper members according to the aspect of the invention, the tape body may be formed of a plurality of layers, a layer on a bag film side of the tape body is a low temperature seal portion, and a layer on a zipper member side of the tape body is a heat-insulating portion.

According to the aspect of the invention, since the tape body is sealed at a low temperature with the layer on the bag film side of the tape body, it is not necessary to raise the heating temperature of the seal bar. In addition, the zipper member side of the tape body is the heat-insulating portion, heat transfer from the tape body to the rotary drum can be restrained. Hence, a seal defect of the tape with the zipper member can be more efficiently avoided.

The low temperature seal portion may be adapted to melt at a temperature lower than that of the layer on the zipper member side by 20 degrees centigrade or more.

Since the difference in melting points between the low temperature seal portion and the layer on the zipper member side is 20 degrees centigrade or more, it is possible to reduce the welding temperature, thereby avoiding a deformation or a crush of the zipper member.

A projection may be formed at a portion abutting to the bag film of the tape body.

With the arrangement according to the aspect of the invention, even when the tape with the zipper member and the bag film are pressed by the seal bar toward the rotary drum side, the projections formed on the bag film side of the tape body reduce pressure applied on the zipper member, thereby avoiding a deformation or the like of the zipper member. Further, since an air layer which is the best heat-insulating layer is provided between the bag film and the portion not occupied by the projections of the tape body, the heat-insulating efficiency can be increased, thereby more efficiently avoiding a seal defect of the tape with the zipper member.

The heat-insulating portion provided on the layer on the zipper member side of the tape body may be a convex portion formed on the layer.

With the arrangement according to the aspect of the invention, since an air layer which is the best heat-insulating layer is provided between the rotary drum and the portion not occupied by the convex portions of the tape body, the heat-insulating efficiency can be increased, thereby more efficiently avoiding a seal defect of the tape with the zipper member.

The whole tape with the zipper member may be accommodated in a tape introducing groove for the tape with the zipper member, the groove having the zipper member introducing groove and a tape introducing groove that continuously extends from the zipper member introducing groove and accommodates the tape body. A seal surface of the tape with the zipper member may be substantially flush with the circumferential surface of the rotary drum.

With the arrangement according to the aspect of the invention, since the whole tape body of the tape with the zipper member is accommodated in the tape introducing groove for the tape with the zipper member formed in the circumferential direction of the rotary drum, no portion protrudes from the outer circumferential surface of the rotary drum. In addition, in such a state, the seal surface of the tape body is substantially flush with the circumferential surface of the rotary drum. Accordingly, no step is formed in the bag film that covers the tape body around the outer circumferential edge of the tape body, thereby avoiding a wrinkle in the bag film. Hence, the welding portion between the tape with the zipper member and the bag film can have a good appearance. Further, since the tape with the zipper member is accommodated in the tape introducing groove for the tape with the zipper member, the tape with the zipper member is not displaced in a width direction when welded. Hence, the width direction dimension of the tape with the zipper member can be small.

The rotary drum may be adapted to abut to the tape with the zipper member with at least an outer circumferential portion of the rotary drum to which the tape with the zipper member abuts heat-insulated.

With the rotary drum, heat of the seal bar can be efficiently utilized for heat-sealing of the tape with the zipper member and the bag film. Accordingly, especially a seal defect of the seal portion on the rear side at a position directly opposite the zipper member can be avoided.

Note that the rotary drum may be a free roller or a driving roller.

By providing in the rotary drum a driving roller having a motor and self-rotated by the motor to use as the rotary drum of the manufacturing method of the aspect of the invention, the rotation number can be appropriately adjusted. Thereby, the tap with the zipper member can be continuously moved.

When a free roller type is used as the rotary drum of the manufacturing method of the aspect of the invention, by continuously pulling the tape with the zipper member in the introducing groove of the roller, the rotary drum can be rotated by using the pulling force. With this arrangement, the tape with the zipper member can be continuously moved.

A manufacturing device according to an aspect of the invention includes: a rotary drum having a zipper member introducing groove formed in a circumferential direction of the rotary drum, the groove introducing and guiding a tape with a zipper member in which the zipper member is integrally formed on one surface side of a tape body of the tape; and a seal bar disposed at a position to face the zipper member introducing groove, the seal bar having a welding surface in a curved shape corresponding to a circumferential surface shape of the rotary drum. The tape with the zipper member and the bag film are heat-sealed by the rotary drum and the seal bar while being overlaid with each other, the zipper member introducing groove continuously extends from a tape introducing groove accommodating the tape body. The tape introducing groove and the zipper member introducing groove forms a tape introducing groove for the tape with the zipper member. The tape introducing groove for the tape with the zipper member has a depth in which the whole tape with the zipper member is accommodated such that a seal surface of the tape body is substantially flush with a circumferential surface of the rotary drum.

According to the aspect of the invention, as stated above, the whole tape body of the tape with the zipper member can be accommodated in the tape introducing groove and the seal surface of the tape body is substantially flush with the circumferential surface of the rotary drum. Hence, no step is formed in the bag film around the outer circumferential edge of the tape body covered with the bag film, so that a wrinkle in the bag film can be avoided.

At least an outer circumferential portion of the rotary drum to which the tape with the zipper member abuts may be made of a heat-insulating material.

According to the aspect of the invention, since at least the outer circumferential portion of the rotary drum is made of a heat-insulating material, as state above, the heat of the seal bar is utilized for heat sealing of the tape with the zipper member and the bag film, thereby avoiding a seal defect.

Note that when a soft material such as foamed rubber or the like is used as the heat-insulating material, the tape with the zipper member may bite into the foamed rubber or the like, so that the seal surface of the tape body may automatically and substantially become flush with the circumferential surface of the rotary drum. In this case, the tape introducing groove may not be provided in advance.

EXPLANATION OF CODES

Figure 1:
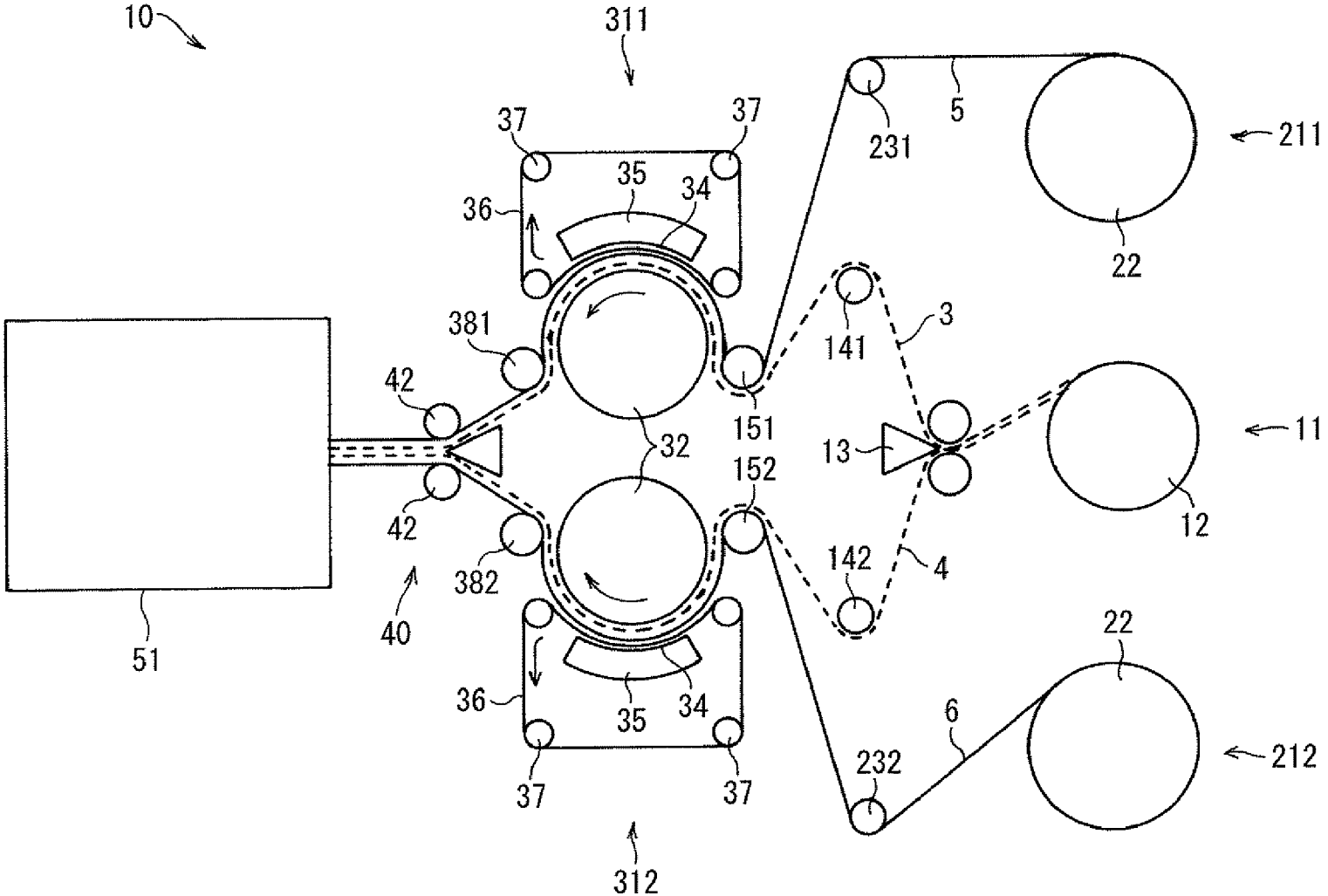
FIG. 1 schematically shows an arrangement of a manufacturing device of an embodiment of the invention.

1, 2: zipper member
3, 4: tape with a zipper member
3C, 4C: projection
3D, 4D: convex portion
5, 6: bag film
10: manufacturing device
31, 41: tape body
32: rotary drum
33: tape introducing groove for a tape with a zipper member
34: welding surface
35: seal bar
331: zipper member introducing groove
332: tape introducing groove

BEST MODE FOR CARRYING OUT THE INVENTION

An embodiment of the present invention will be described below with reference to the drawings.

FIG. 1 shows a manufacturing device of a bag with a zipper member. In FIG. 1, a manufacturing device 10 includes a provider 11 for a tape with a zipper member, the provider 11 separately providing a tape 3 with a male zipper member and a tape 4 with a female zipper member which are engageable with each other by a pair of zipper members 1 and 2 (see FIG. 4); first and second bag film providers 211 and 212 that respectively provide bag films 5 and 6; a first welding unit 311 that heat-seals the tape 3 with the male zipper member to the bag film 5 provided by the first bag film provider 211; a second welding unit 312 that heat-seals the tape 4 with the female zipper member to the bag film 6 provided by the second bag film provider 212; a re-engaging unit 40 having a pair of rollers 42 that re-engages the zipper members 1 and 2 with each other respectively welded on the tapes 3 and 4 with the zipper members by the first and second welding units 311 and 312; and a bag manufacturing device 51 for manufacturing a bag of the bag films 5 and 6 in engagement by the re-engaging unit 40.

The provider 11 for the tape with the zipper member includes a tape reeling roller 12 around which the tape 3 with the male zipper member and the tape 4 with the female zipper member are wound with the pair of zipper members 1 and 2 engaged with each other; and a separator 13 that separates the tape 3 with the male zipper member and the tape 4 with the female zipper member from each other which are drawn from the tape reeling roller 12. The tape 3 with the male zipper member and the tape 4 with the female zipper member which are separated from each other are respectively sent to the first welding unit 311 and the second welding unit 312 via intermediate rollers 141 and 142 and overlaying rollers 151 and 152.

The bag film providers 211 and 212 respectively include film reeling rollers 22 around which the bag films 5 and 6 wound in a roll-like manner, the bag films 5 and 6 made of a single or multiple synthetic resin layers. The bag films 5 and 6 drawn from the film reeling rollers 22 are respectively sent via the intermediate rollers 231 and 232 to the overlaying rollers 151 and 152, where the bag films 5 and 6 are respectively overlaid with the tape 3 with the male zipper member and the tape 4 with the female zipper member and then sent to the first and second welding units 311 and 312.

Figure 2:
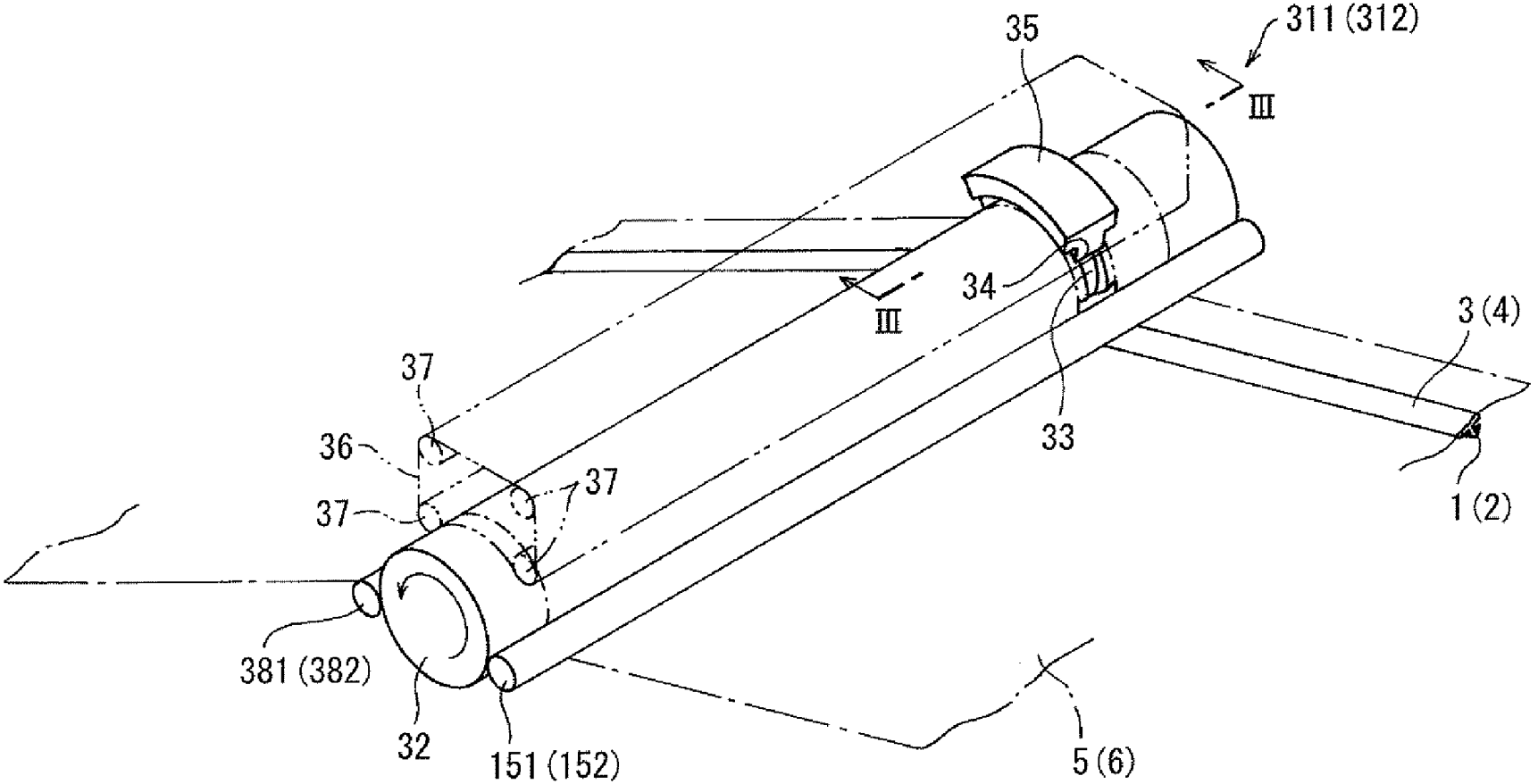
FIG. 2 is a perspective view showing a welding unit of the aforesaid embodiment.

As shown in FIG. 2, the first and second welding units 311 and 312 each include a rotary drum 32 rotated by a drive source (not shown); a tape introducing groove 33 for a tape with a zipper member, the tape introducing groove 33 formed along a circumferential direction of the rotary drum 32 to introduce and guide the zipper member 1, 2 of the tape 3, 4; a seal bar 35 positioned to face the tape introducing groove 33 for the tape with the zipper member, the seal bar 35 having a welding surface 34 in a curved shape corresponding to a circumferential shape of the rotary drum 32; and a looped belt 36 movable in a rotation direction of the rotary drum 32 such that a portion of the looped belt 36 travels between circumferential surfaces of the seal bar 35 and the rotary drum 32. Components 381 and 382 are pressing rollers.

The rotary drum 32 is athermic when the tape 3, 4 with the zipper member is heat-sealed to the bag film 5, 6 between the rotary drum 32 and the seal bar 35. For example, the whole of the rotary drum 32 or an outer circumferential portion of the rotary drum 32 to which the tape 3, 4 abuts may be made of a heat insulating material. The heat insulating material includes rubber, a foamed material, a porous material and the like. In providing the heat insulating material of the outer circumferential portion, the heat insulating material may be formed in a sheet-like shape and wound around the outer circumferential surface of the rotary drum 32.

Figure 3:
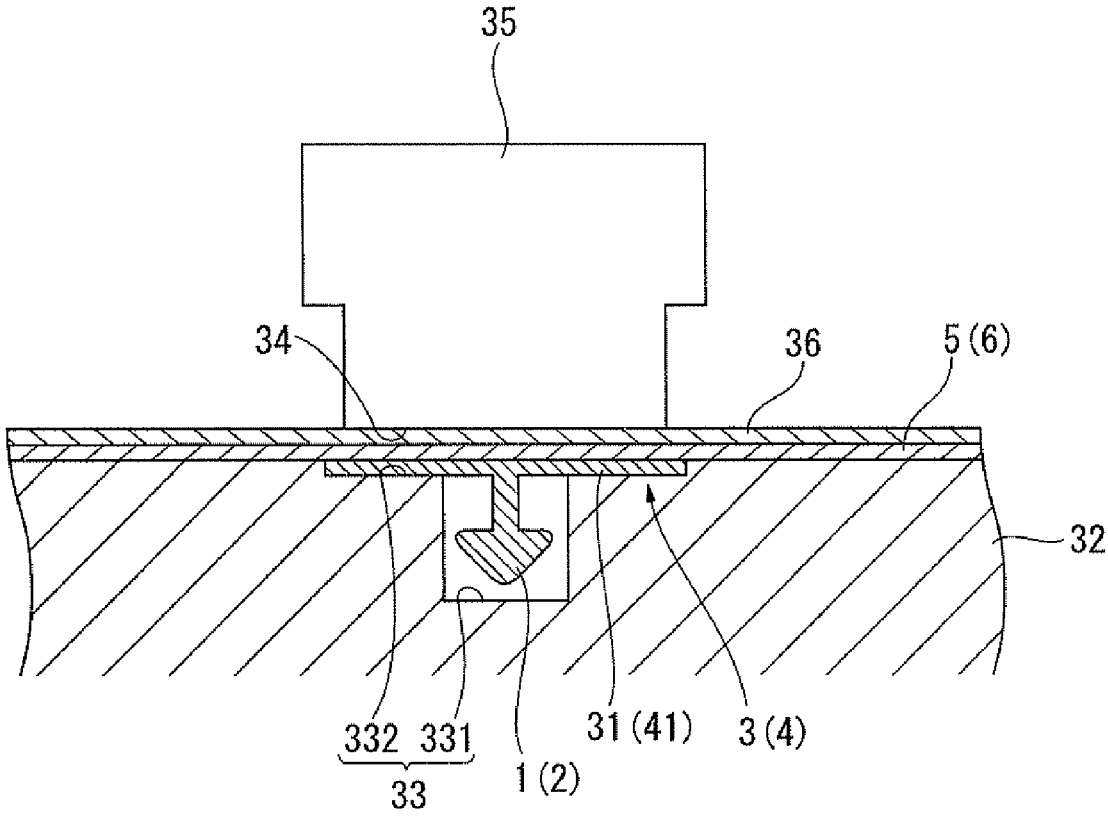
FIG. 3 is a cross section taken along III-III line in FIG. 2.

FIG. 3 shows an exemplary arrangement of the tape with the zipper member accommodated in the tape introducing groove 33 for the tape with the zipper member, the tape introducing groove 33 including a zipper member introducing groove 331 and a tape introducing groove 332 which are integrally formed.

In FIG. 3, the tape 3 with the male zipper member and the tape 4 with the female zipper member respectively have the zipper member 1, 2 each integrally formed at a center portion on one surface side of a tape body 31, 41. The tape 3, 4 with the zipper member may be made from an appropriate synthetic resin such as polyethylene. The bag film 5, 6 on which the tape 3, 4 with the zipper member may be made of a single layer or multiple layers of synthetic resin materials such as a laminate film of which outer layer is made from nylon and inner layer is made from polyethylene.

The tape introducing groove 33 for the tape with the zipper member for the tape includes the zipper member introducing groove 331 accommodating the zipper member 1, 2; and the tape introducing groove 332 integrally formed with the zipper member introducing groove 331, the tape introducing groove 332 having a depth substantially the same as a thickness of the tape body 31, 41.

The zipper member introducing groove 331 has a substantially rectangular shape of which cross section is sufficient in size to accommodate the zipper member 1, 2. A bottom surface of the zipper member introducing groove 331 is substantially in parallel to the circumferential surface of the rotary drum 32. Lateral facing surfaces of the zipper member introducing groove 331 each have a longer length than that of the zipper member 1, 2.

The tape introducing groove 332 includes a bottom surface continuously extending from the lateral surfaces of the zipper member introducing groove 331; and lateral surfaces formed so as to rise from ends of the bottom surface of the tape introducing groove 332.

A height of the lateral surfaces of the tape introducing groove 332 (a depth of the tape introducing groove 332) is substantially the same as the thickness of the tape body 31, 41. When the tape 3, 4 with the zipper member is accommodated in the tape introducing groove 33 for a tape with a zipper member, a seal surface of the tape body 31, 41 is substantially flush with the circumferential surface of the rotary drum 32.

A width of the tape introducing groove 332 is substantially the same as that of the tape body 31, 41 or slightly larger than that. In the embodiment, the width of the tape body 31, 41 may be 10 mm or less, preferably 3 to 7 mm or more preferably 3 to 5 mm.

A width of the welding surface 34 of the seal bar 35 is slightly smaller than that of the tape 3, 4 with the zipper member. A length of the seal bar 35 (an angle to cover the circumferential surface of the rotary drum 32) may be appropriately selected in accordance with a size of the zipper member 1, 2 and a thickness of the bag film 5, 6 and the like such that the zipper member 1, 2 can be reliably welded on the bag film 5, 6.

The looped belt 36 may be made of a heat-resistant material such as a glass fiber woven fabric and formed in a looped belt-like shape. The looped belt 36 is disposed such that a portion of the looped belt 36 is moved between the circumferential surfaces of the seal bar 35 and the rotary drum 32 by four rollers 37. It is good that the looped belt 36 is self-propelled by arranging at least one roller 37 as a driving roller.

Next, a manufacturing method of the bag with the zipper member according to one embodiment of the invention will be described.

The tape 3 with the male zipper member and the tape 4 with the female zipper member which are drawn from the tape reeling roller 12 are separated by the separator 13. Then, the tape 3, 4 is overlaid with the bag film 5, 6 drawn from the film reeling roller 22 of the bag film provider 211, 212 and sent to the first or second welding unit 312, 313.

In the welding unit 311, 312, the tape body 31, 41 of the tape 3, 4 with the zipper member and the bag film 5, 6 are continuously moved by rotation of the rotary drum 32 in a state in which: the tape body 31, 41 of the tape 3, 4 is overlaid with the bag film 5, 6; the zipper member 1, 2 of the tape 3, 4 travels through the zipper member introducing groove 331 of the rotary drum 32; and the tape body 31, 41 travels through the tape introducing groove 332, while the tape body 31, 41 and the bag film 5, 6 are continuously heat-sealed by the seal bars 35.

When the tape 3, 4 with the zipper member travels in the tape introducing groove 33 for the tape with the zipper member of the rotary drum 32, the whole of the tape 3, 4 with the zipper member is accommodated in the tape introducing groove 33 for the tape with the zipper member and the seal surface of the tape body 31, 41 is substantially flush with the circumferential surface of the rotary drum 32.

In this process, since the looped belt 36 travels between the bag film 5, 6 and the seal bar 35, in other words, since the bag film 5, 6 never travels while abutting to the seal bar 35, the bag film 5, 6 does not receive too much force, so that the bag film 5, 6 can stably travel.

Figure 4:
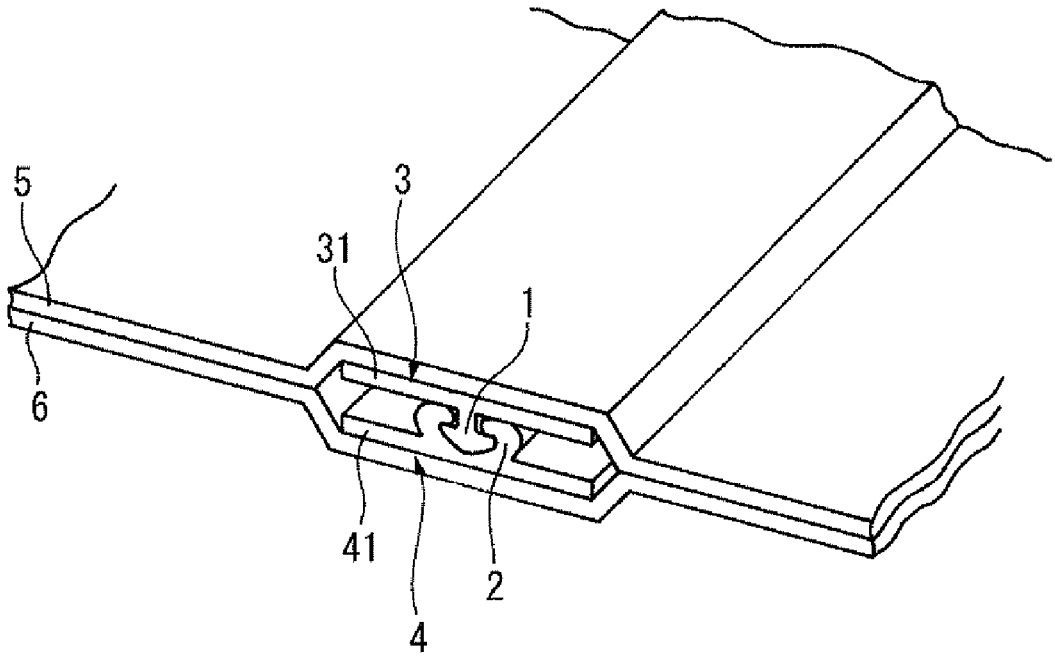
FIG. 4 is a perspective view showing a primary portion of a bag with a zipper member manufactured in the aforesaid embodiment.

The zipper member 1 of the tape 3 with the zipper member welded to the bag film 5 in the welding unit 311 is re-engaged with the zipper member 2 of the tape 4 with the zipper member welded to the bag film 6 in the welding unit 312 by the re-engaging unit 40 such that a bag is made by the bag manufacturing device 51. Thereby, the bag with the zipper members is manufactured. FIG. 4 shows a primary portion of the thus-manufactured bag with the zipper members.

In the manufacturing method of the bag with the zipper members according to the invention, the method is not limited to be the one for manufacturing the bag shown in FIG. 3. The method can be used for manufacturing a bag with a zipper member having another structure.

Figure 5:
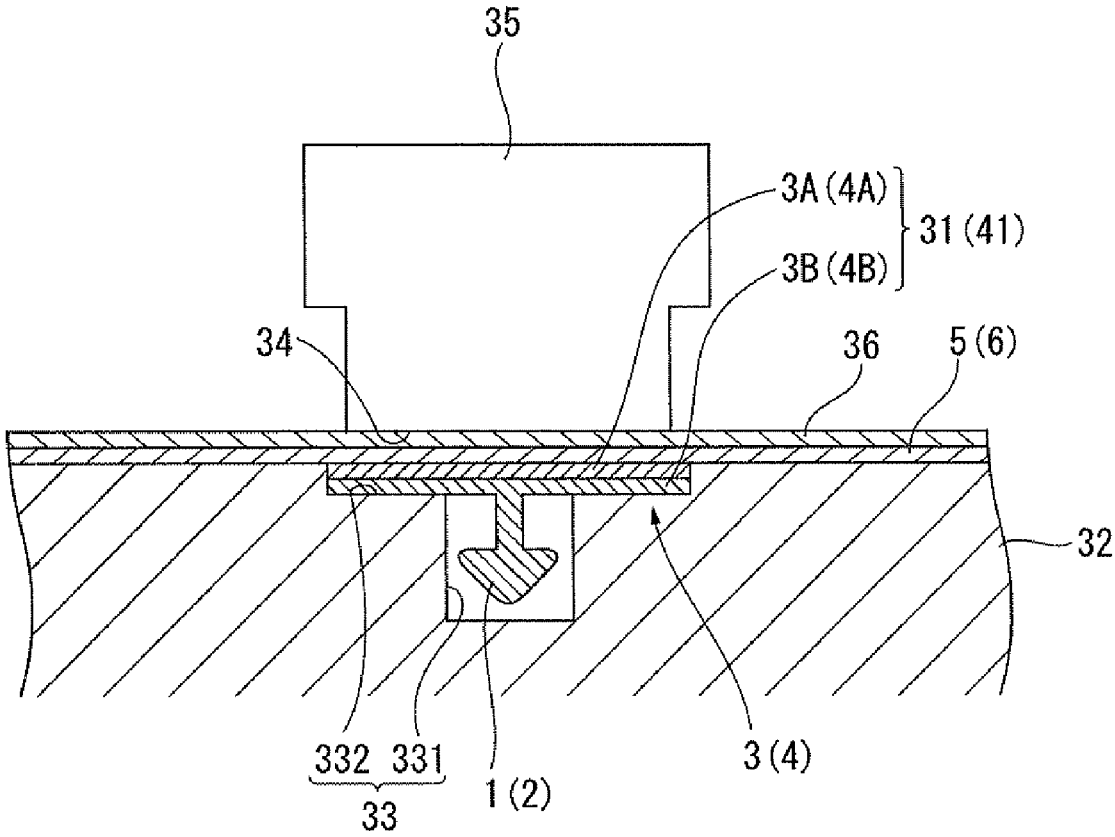
FIG. 5 is a cross section showing a tape with a zipper member having a shape different from that shown in FIG. 3.

For example, as shown in FIG. 5, the tape body 31, 41 may be formed by a plurality of layers 3A, 3B, 4A and 4B, and the layer 3B, 4B on the zipper member 1, 2 side may be a heat-insulating portion. In such an arrangement, the layer 3A, 4A on the bag film 5, 6 side needs to be a low temperature seal portion. The layer 3A, 4A forming the low temperature seal portion may be made of a low temperature material having a lower melting point than that of the layer 3B, 4B on the zipper member side by 20 degrees centigrade or more or preferably by 40 degrees centigrade or more.

Figure 6:
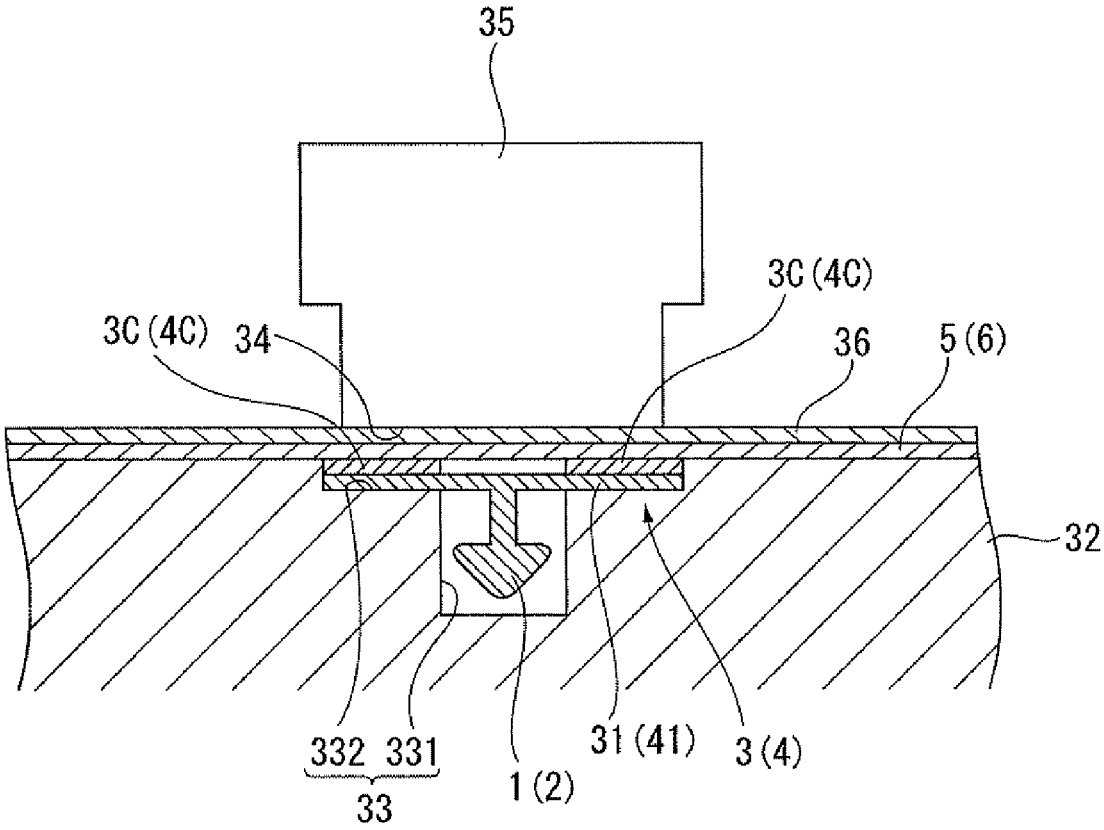
FIG. 6 is a cross section showing the tape with the zipper member having a shape different from that shown in FIG. 3.

In the embodiment as shown in FIG. 6, projections 3C, 4C may be provided to the tape body 31, 41 at a position on which the tape body 31, 41 abuts to the bag film. The projections 3C, 4C may be integrally formed with the tape body 31, 41. Alternatively, the projections 3C, 4C may be formed individually and fixed to the tape body 31, 41 using an adhesive or the like.

Figure 7:
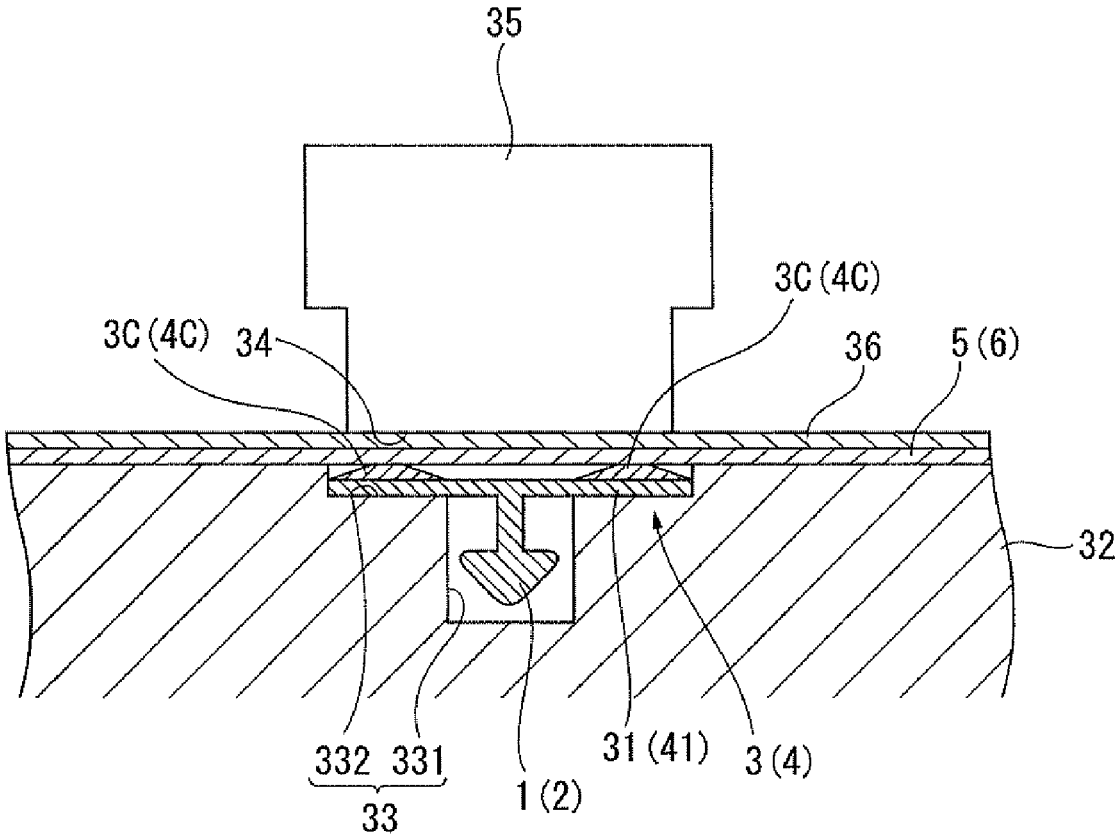
FIG. 7 is a cross section showing the tape with the zipper member having a shape different from that shown in FIG. 3.

The projections 3C, 4C are disposed on ends in a width direction of the tape body 31 41. A cross section of the projections 3C, 4C is rectangular. However, the cross section is not limited to the rectangular shape but may be a substantially triangle shape as shown in FIG. 7. In addition, the cross section may be a semicircle, a trapezoid or a dot shape. The shape or the number of the projections 3C, 4C may be selected without limitation.

Figure 8:
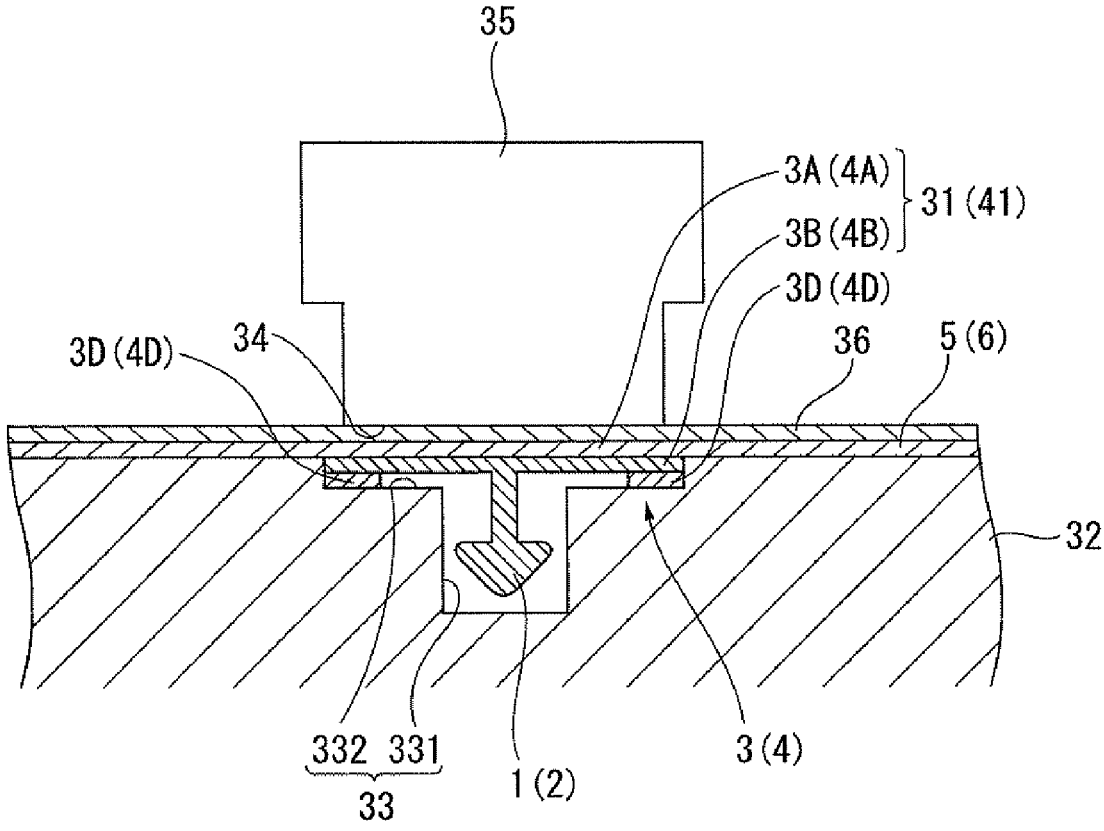
FIG. 8 is a cross section showing the tape with the zipper member having a shape different from that shown in FIG. 3.

As shown in FIG. 8, convex portions 3D, 4D may be provided on the zipper member 1, 2 side of the tape body 31, 41. The convex portions 3D, 4D abut to the bottom surface of the tape introducing groove 332, the convex portions 3D, 4D formed on ends in the width direction of the tape body 31, 41.

The convex portions 3D, 4D may be integrally formed with the tape body 31, 41. Alternatively, the convex portions 3D, 4D may be formed individually and fixed to the tape body 31, 41 using an adhesive or the like. Although the cross section is rectangular in FIG. 8, the shape may be a substantially triangle, a semicircle, a trapezoid or a dot shape. The shape or the number of the convex portions 3D, 4D may be selected without limitation. The tape body 31, 41 shown in FIG. 3 may be formed by providing the convex portions 3D, 4D to a single layer of the tape 3, 4 with the zipper member.

The thus-arranged tape 3, 4 with the zipper member can be welded to the bag film 5, 6 with a method similar to that of the tape 3, 4 with the zipper member shown in FIG. 3, and accordingly a bag with zipper members can be manufactured.

In the embodiment, following exemplary effects and advantages can be obtained.

(1) The tape 3, 4 with the zipper member is continuously moved by the rotation of the rotary drum 32 with an arrangement in which the tape 3, 4 with zipper member is overlaid with the bag film 5, 6 such that the tape 3, 4 can travel in the zipper member introducing groove 331 formed along the circumferential direction of the rotary drum 32. Heat applied on the tape 3, 4 with the zipper member when the tape 3, 4 is continuously heat-sealed to the bag film 5, 6 by the seal bar 35 having the welding surface 34 in the curved shape corresponding to the circumferential shape of the rotary drum 32 can be prevented from transferring to the rotary drum 32.

With such an arrangement, the tape body 31, 41 can be efficiently welded to the bag film 5, 6.

(2) The tape body 31, 41 is formed of a plurality of layers. Out of the plurality of layers, the layer 3A, 3B on the zipper member side is the heat-insulating portion. With such an arrangement, heat generated on the seal bar 35 will not escape to the outside via the tape body 31, 41. Hence, the tape 3, 4 with the zipper member can be efficiently welded to the bag film 5, 6.

(3) The layer 3A, 4A on the bag film side out of the tape body 31, 41 is the low temperature seal portion. With such an arrangement, the tape body 31, 41 can be easily welded to the bag film 5, 6 without necessity of raising a heating temperature of the seal bar 35 or reducing time in which the seal bar 35 abuts to the bag film.

(4) The layer 3B, 4B of the low seal portion is adapted to be melted at a low temperature lower than that of the layer 3A, 4A on the zipper member side by 20 degrees centigrade or more. Hence, since a difference in melting points is provided between the layer 3A, 4A and the layer 3B, 4B by 20 degrees centigrade or more, it is possible to lower the heating temperature, thereby avoiding a deformation or a crush of the zipper member 1, 2.

(5) The projection 3C, 4C is provided to the tape body 31, 41 at a position to abut to the bag film. With such an arrangement, even when the seal bar 35 presses the tape 3, 4 with the zipper member and the bag film 5, 6 toward the rotary drum 32 side, the zipper member 1, 2 will receive less pressure from the projection 3C, 4C, thereby avoiding a deformation or the like of the zipper member 1, 2.

(6) Since the convex portion 3D, 4D is provided on the zipper member 1, 2 side of the tape body 31, 41, the convex portion 3D, 4D can function as a heat-insulating material. Accordingly, heat generated on the seal bar 35 will not escape from the rotary drum 32 via the tape body 31, 41 to the outside, so that the tape 3, 4 with the zipper member can be efficiently welded to the bag film 5, 6.

(7) In particular, by forming the convex portion 3D, 4D in a triangle shape in cross section, heat transferred from the tape body 31, 41 can be less transferred to the rotary drum 32.

(8) The whole tape 3, 4 with the zipper member is accommodated in the tape introducing groove 33 for the tape with zipper member such that the seal surface of the tape body 31, 41 is substantially flush with the circumferential surface of the rotary drum 32. Hence, when the tape 3, 4 with the zipper member and the bag film 5, 6 are welded by the rotary drum 32 and the seal bar 35, no portion of the tape 3, 4 will protrude from the circumferential surface of the rotary drum 32. Hence, no wrinkle will occur in the bag film 5, 6 covering the tape body 31, 41. Accordingly, an appearance of the welding portion can be good.

(9) The tape introducing groove 33 for the tape with the zipper member is provided with: the zipper member introducing groove 331 for accommodating the zipper member 1, 2; and the tape introducing groove 332 continuously formed with the zipper member introducing groove 331 and having the substantially same depth as the thickness of the tape body 31, 41. Hence, when the tape 3, 4 with the zipper member is welded to the bag film 5, 6 by the seal bar 35, the tape body 31, 41 is pressed to the bottom surface of the tape introducing groove 332 by the seal bar 35; and the zipper member 1, 2 is accommodated in the zipper member introducing groove 331 having a larger depth than that of the tape introducing groove 332. Accordingly, only a necessary portion is pressed for the welding, thereby increasing the welding efficiency.

(10) Since at least the circumferential portion of the rotary drum 32 is made of the heat-insulating material, heat generated on the seal bar 35 will not escape to the rotary drum 32. Hence, the tape 3, 4 with the zipper member can be efficiently welded to the bag film 5, 6 between the rotary drum 32 and the seal bar 35.

Note that when a soft material such as foamed rubber or the like is used as the heat-insulating material of the circumferential portion of the rotary drum 32, the tape with the zipper member may bite into the foamed rubber or the like, so that the seal surface of the tape body automatically and substantially becomes flush with the circumferential surface of the rotary drum 32. In this case, the tape introducing groove 332 may not be provided in advance.

EXAMPLES

Advantages of the embodiment of the invention will be described and confirmed using following examples.

Example 1 a) A bag with zipper members was manufactured using a laminate film as the bag film 5, 6 and a linear low-density polyethylene of which melting point is 120 degrees centigrade as the tape 3, 4 with the zipper member. The laminate film had an outer layer made of a biaxially oriented nylon and an inner layer made of a linear low-density polyethylene. Herein, the tape 3, 4 had a width of 7 mm.

b) The temperature of the seal bar 35 was about 150 degrees centigrade.

c) The tape introducing groove 33 for the tape with the zipper member had a shape shown in FIG. 3.

Example 2 a), c)

However, the temperature of the seal bar 35 in b) is about 145 degrees centigrade. The tape 3, 4 with the zipper member has a structure shown in FIG. 5. The layer 3A, 4A of the tape body 31, 41 was made of metallocene LLDPE (Linear Low Density PolyEthylene) of which melting point is 95 degrees centigrade. The layer 3B, 4B was made of a linear low-density polyethylene of which melting point is 120 degrees centigrade.

Example 3 a), c)

However, the temperature of the seal bar 35 in b) was about 125 degrees centigrade. The tape 3, 4 with the zipper member had a structure shown in FIG. 8. The convex portion 3D, 4D had a substantially triangle cross section. The height protruding from the layer 3B, 4B of the convex portion 3D, 4D was 0.3 mm. Two convex portions 3D, 4D were provided on sides in the longitudinal direction of the tape of the zipper members 1, 2. The layer 3A, 4A of the tape body 31, 41 was made of metallocene LLDPE of which melting point is 95 degrees centigrade. The layer 3B, 4B was made of a linear low-density polyethylene of which melting point is 120 degrees centigrade.

[Comparison]

a) and b)

The zipper member introducing groove has the same structure as that of a related art example (Patent Document 2). The tape body has a structure protruding from the outer circumferential surface of the rotary drum of the tape body.

EVALUATIONS AND RESULTS

Whether or not Wrinkle Occurs in Vicinity of Tape with Zipper Member after Welding In Comparison, a wrinkle was observed. In Examples 1 to 3, no wrinkle was observed.

[Deformation of Zipper Member]

In Comparison, deformation was observed after welding. In Examples 1 to 3, no deformation comparable to the deformation in Comparison was observed.

It should be appreciated that the present invention is not limited to the above-described embodiment, and modifications, improvements and the like can be provided without departing from the scope of the invention to achieve an object of the invention.

For example, in the embodiment, the tape introducing groove 33 for the tape with the zipper member is formed of the zipper member introducing groove 331 and the tape introducing groove 332, the tape introducing groove 33 having a cross section in a convex portion shape. However, the tape introducing groove 33 with the tape with the zipper member may have any other shape such as a triangle and a semicircle as long as the zipper member 1, 2 and the tape body 31, 41 can be accommodated in the tape introducing groove 33 with the tape with the zipper member.

When at least the outer circumferential portion of the rotary drum 32 to which the tape with the zipper member abuts is heat-insulated, it is not necessary to provide the tape introducing groove 332.

In the embodiment, two rotary drums 32 are provided such that one rotary drum 32 can heat-seal the tape 3 with the male zipper member to the bag film 5 and the other rotary drum 32 can heat-seal the tape 4 with the female zipper member to the bag film 6. However, only one rotary drum may be provided in which a zipper member introducing groove and a tape introducing groove for a tape with a zipper member are formed such that the tape 3 with the male zipper member and the tape 4 with the female zipper member can be heat-sealed to the bag films.

INDUSTRIAL APPLICABILITY

The present invention can be applied to a packaging bag for food, a packaging bag for medical use and other packaging bags.

The invention claimed is:

1. A manufacturing method for a bag with zipper members, comprising:

overlaying a bag film with a tape with a zipper member in which the zipper member is integrally formed on one surface side of a tape body of the tape such that the tape with the zipper member travels in a zipper member introducing groove formed in a circumferential direction of a rotary drum, the tape and the bag film moved by rotation of the rotary drum in the overlaid state; and continuously heat-sealing the tape with the zipper member to the bag film by a seal bar having a welding surface in a curved shape corresponding to a circumferential shape of the rotary drum, wherein a heat-insulating portion is provided on at least one of the tape body of the tape and the rotary drum so that heat applied by the seal bar to the tape with the zipper member is prevented from transferring to the rotary drum.

2. The manufacturing method of the bag with the zipper members according to claim 1, wherein the tape body is formed of a plurality of layers, a layer on a bag film side of the tape body is a low temperature seal portion, and a layer on a zipper member side of the tape body is a heat-insulating portion.

3. The manufacturing method of the bag with the zipper members according to claim 2, wherein the low temperature seal portion melts at a temperature lower than that of the layer on the zipper member side by 20 degrees centigrade or more.

4. The manufacturing method of the bag with the zipper members according to claim 1, wherein a projection is formed at a portion abutting to the bag film of the tape body.

5. The manufacturing method of the bag with the zipper members according to claim 1, wherein the heat-insulating portion provided on the layer on the zipper member side of the tape body is a convex portion formed on the layer.

6. The manufacturing method of the bag with the zipper members according to claim 1, wherein the whole tape with the zipper member is accommodated in a tape introducing groove for the tape with the zipper member, the groove having the zipper member introducing groove and a tape introducing groove that continuously extends from the zipper member introducing groove and accommodates the tape body, and a seal surface of the tape with the zipper member is substantially flush with the circumferential surface of the rotary drum.

7. The manufacturing method of the bag with the zipper members according to claim 1, wherein the rotary drum abuts to the tape with the zipper member with at least an outer circumferential portion of the rotary drum to which the tape with the zipper member abuts heat-insulated.

* * * * *